US008118638B2

(12) United States Patent
Forbes

(10) Patent No.: US 8,118,638 B2
(45) Date of Patent: Feb. 21, 2012

(54) NURSING BRA

(76) Inventor: Michelle Forbes, Brooklyn, NY (US)

( * ) Notice: Subject to any disclaimer, the term of this patent is extended or adjusted under 35 U.S.C. 154(b) by 223 days.

(21) Appl. No.: 12/570,037

(22) Filed: Sep. 30, 2009

(65) Prior Publication Data

US 2011/0076919 A1 Mar. 31, 2011

(51) Int. Cl.
*A41C 3/00* (2006.01)

(52) U.S. Cl. ..... 450/36; 450/1

(58) Field of Classification Search ..... 450/36, 450/86, 88, 28, 1, 92, 93, 64–72, 11, 58; 2/67, 104–106
See application file for complete search history.

(56) References Cited

U.S. PATENT DOCUMENTS 3,311,112 A * 3/1967 Murray ..... 450/1
3,847,158 A * 11/1974 Guidoni ..... 450/68
3,939,845 A * 2/1976 Guidoni ..... 450/68
4,031,900 A * 6/1977 Guidoni ..... 450/69
4,411,269 A * 10/1983 Weintraub ..... 450/58
6,402,586 B1 * 6/2002 Winik et al. ..... 450/78
6,685,535 B2 * 2/2004 Mitchell ..... 450/75
6,899,591 B2 * 5/2005 Mitchell ..... 450/65
7,547,241 B2 * 6/2009 Sakabe et al. ..... 450/70
2007/0281583 A1 * 12/2007 Sakabe et al. ..... 450/1

* cited by examiner

*Primary Examiner* — Gloria Hale
(74) *Attorney, Agent, or Firm* — Jeffrey Sonnabend; SonnabendLaw

(57) ABSTRACT

The present invention provides a nursing bra having first and second breast cup members attached to a chest strap assembly. The strap assembly includes a primary band assembly for securing said nursing bra to a user's upper chest and a separate secondary band assembly coupled to each first and second breast cup. The separate secondary band assembly is configured and operable to provide slidable movement of each of the first and second breast cups relative to the primary band assembly for uncovering a breast during a nursing application.

19 Claims, 3 Drawing Sheets

NURSING BRA

FIELD OF THE INVENTION

This invention generally relates to women's garments, and more specifically, to a nursing bra.

BACKGROUND

There are numerous nursing bra designs which have attempted to provide for conveniently breast feeding infants. Such designs have been in the general form of traditional bras with "hinged" breast cups. These designs have attempted to allow a measure of convenience to the mother, by permitting her to nurse her child without the need to remove the entire garment.

However, none of the prior nursing bra designs have been incorporated into bikini type garments due to the differences between traditional garment designs on the one hand and bikini designs on the other. In particular, breast cup, under wire/supporting wire and straps have differed between the two garment types.

For example, traditional nursing bra designs often utilize clasps for retaining the breast cup in its non-feeding position. These clasps can be difficult to use and may be visually unappealing. Furthermore, clasps often require two hands for operation, and often expose for feeding less than the whole breast.

Traditional nursing bras are usually "hinged" at the bottom of the breast cup and clasped at the top, and thus require women to lift pullover type (i.e., non-button-down) garments completely over the breast to place the bra into feeding position. This arrangement may lead to public exposure of the woman's breast due to the opposite direction of breast cup movement vs. garment movement required to place the breast in feeding position (i.e., the downward movement of the hinged breast cup as opposed to the upward movement of the garment). Many women find this awkward, and more modest women may consider it undesirable.

Bikini type nursing bras may provide alternative opening means (i.e., means for exposing the breast for nursing) which avoid such clasps, making the bikini style nursing bra more discrete and attractive. They also may be operated with one hand (e.g., by one-handedly sliding a breast cup). Furthermore, because bikini style nursing bras excluded clasps and other hardware, they may be more suited for use as bras after a woman is no longer nursing. Bikini type nursing bras also may be conveniently used with all types of garments by eliminating the "opposite movement" problem discussed above.

Finally, the manufacture of traditional nursing bras require significantly more fabric than comparable bikini style nursing bras.

Therefore, while prior nursing bra designs have in essence fulfilled their objectives and requirements, the need remains for a nursing bra which provides the support and other application specific design elements of nursing bras with those of bikinis.

SUMMARY OF THE INVENTION

In an illustrated embodiment, the present invention provides a nursing bra having first and second breast cups configured to respectively cover at least a portion of a user's breast. Each of the first and second breast cups may be defined by a top edge and a bottom edge, wherein each bottom edge is formed to have an inner channel portion. First and second elongate support straps may be provided with each having a first end and a second opposing end wherein the first end of the first and second elongate support straps are respectively coupled to the top edge of the first and second breast cups.

Embodiments of the present invention may include straps which are adjustable and worn under clothing without showing, unlike bikini straps, which are generally in the form of strings and tie behind the neck and back. Furthermore, embodiments of the present invention may be of fabric that is breathable and/or soft so as not to constrict sensitive breast tissue.

Further, a chest strap assembly may be included having a primary strap configured to conform against a front chest portion of a user so as to support the garment against the front chest portion of the user. The chest strap assembly may include a rear strap configured to secure the garment against a back torso portion of the user. Furthermore, the chest strap assembly may include a secondary strap configured to slidably receive in the inner channel portion of the first and second breast cups such that each first and second breast cup is slidably adjustable on the secondary strap.

BRIEF DESCRIPTION OF THE DRAWINGS

The objects and features of the invention may be understood with reference to the following detailed description of an illustrative embodiment of the present invention taken together in conjunction with the accompanying drawings in which.

DETAILED DESCRIPTION

Figure 1:
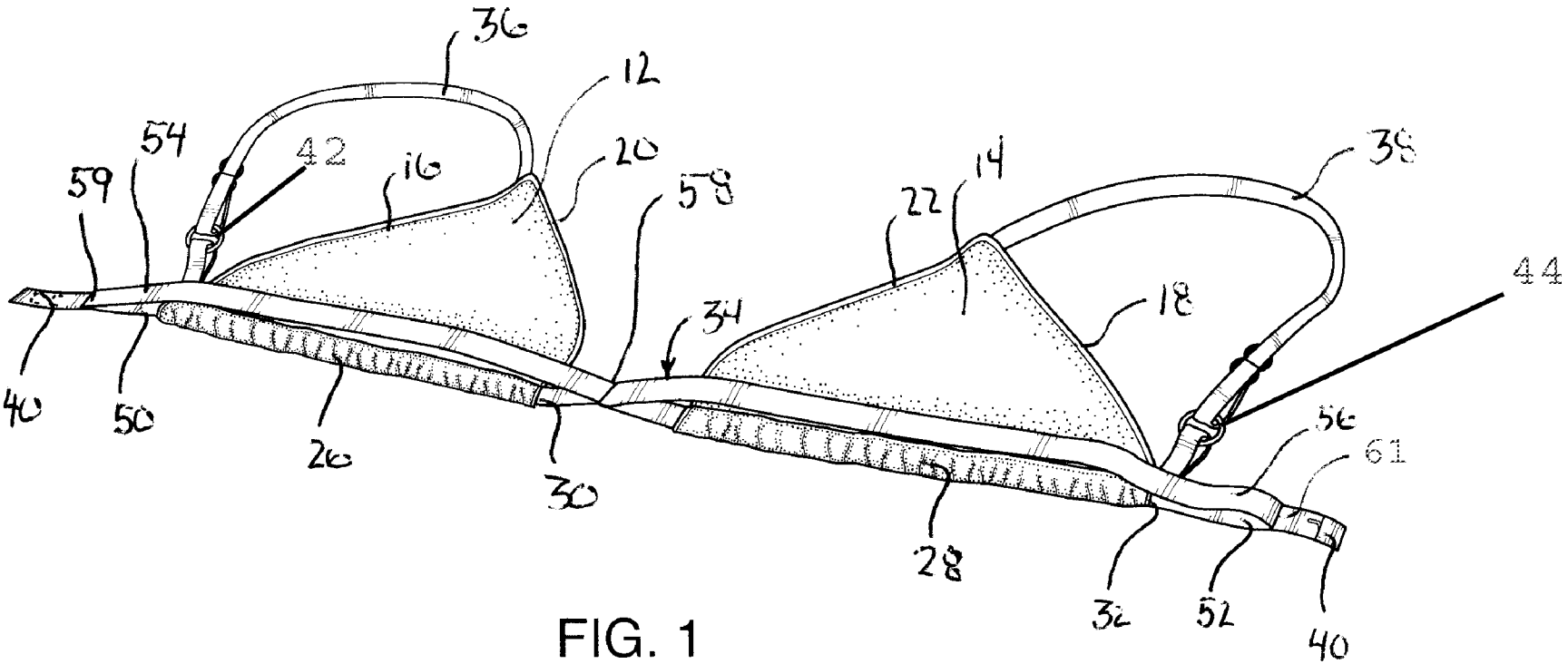
FIG. 1 is a perspective view of a nursing bra in accordance with an illustrated embodiment of the invention.

The present invention will now be described more fully with reference to the accompanying drawings, in which illustrated embodiments of the present invention are shown. The present invention is not limited in any way to any of the illustrated embodiments.

With reference now to the drawings, and in particular to FIGS. 1 through 4, a new nursing bra embodying the principles and concepts of an illustrated embodiment of the present invention, and generally designated by reference numeral 10, will now be described.

Figure 2:
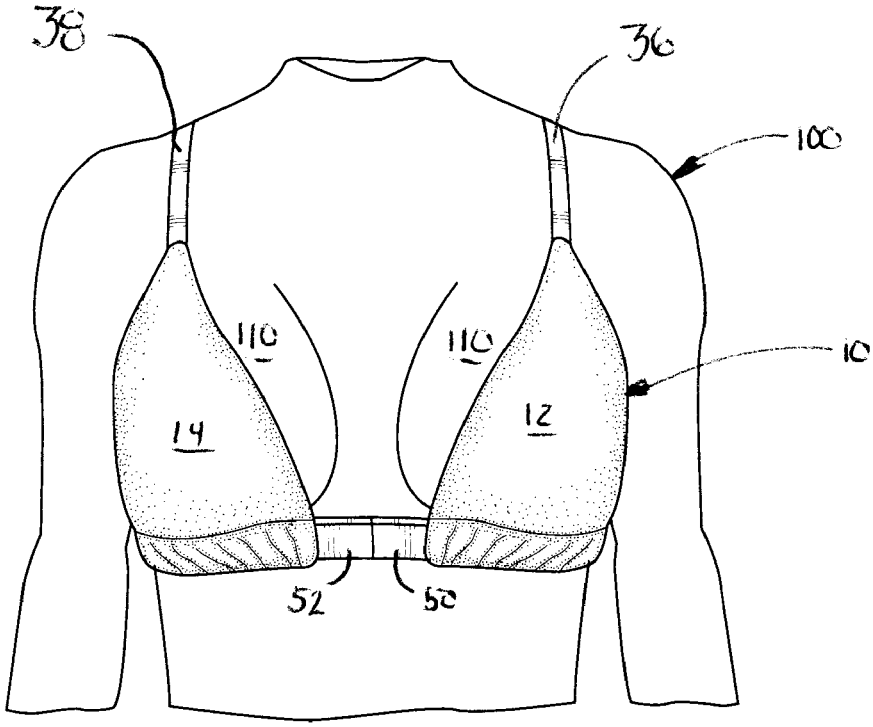
FIG. 2 is a front perspective view of the nursing bra of FIG. 1 being worn by a user.

As best illustrated in FIGS. 1 and 2, the nursing bra 10 is configured to cover a pair of breasts 110 on the upper-torso portion of a user 100. The nursing bra 10 includes first and second breast cups 12, 14. Each of the breast cups 12, 14 covers at least a portion of an associated breast 110. As shown in the illustrated embodiment, preferably each first and second breast cup 12, 14 has a generally triangular configuration.

Each of the breast cups 12, 14 respectively has an outer edge 16, 18 and an inner edge 20, 22. Each of the aforesaid outer edge 16, 18 and inner edge 20, 22 may be formed with an elastic band. Each breast cup 12, 14 also respectively includes a bottom cup edge 26, 28 configured to form a cup area having a size covering at least a portion of the user's breast 110. Each bottom edge 26, 28 of each of the breast cup 12, 14 is preferably folded and sewn to form a respective inner channel 30, 32 therealong wherein a portion of the elastic chest strap assembly 34 slidably passes through each inner channel 30, 32 such that each first and second breast cup 12, 14 is enabled to slide along the elastic chest strap assembly 34 to expose one, or both of the breasts 110, for nursing applications, as to be discussed further below.

Figure 4:
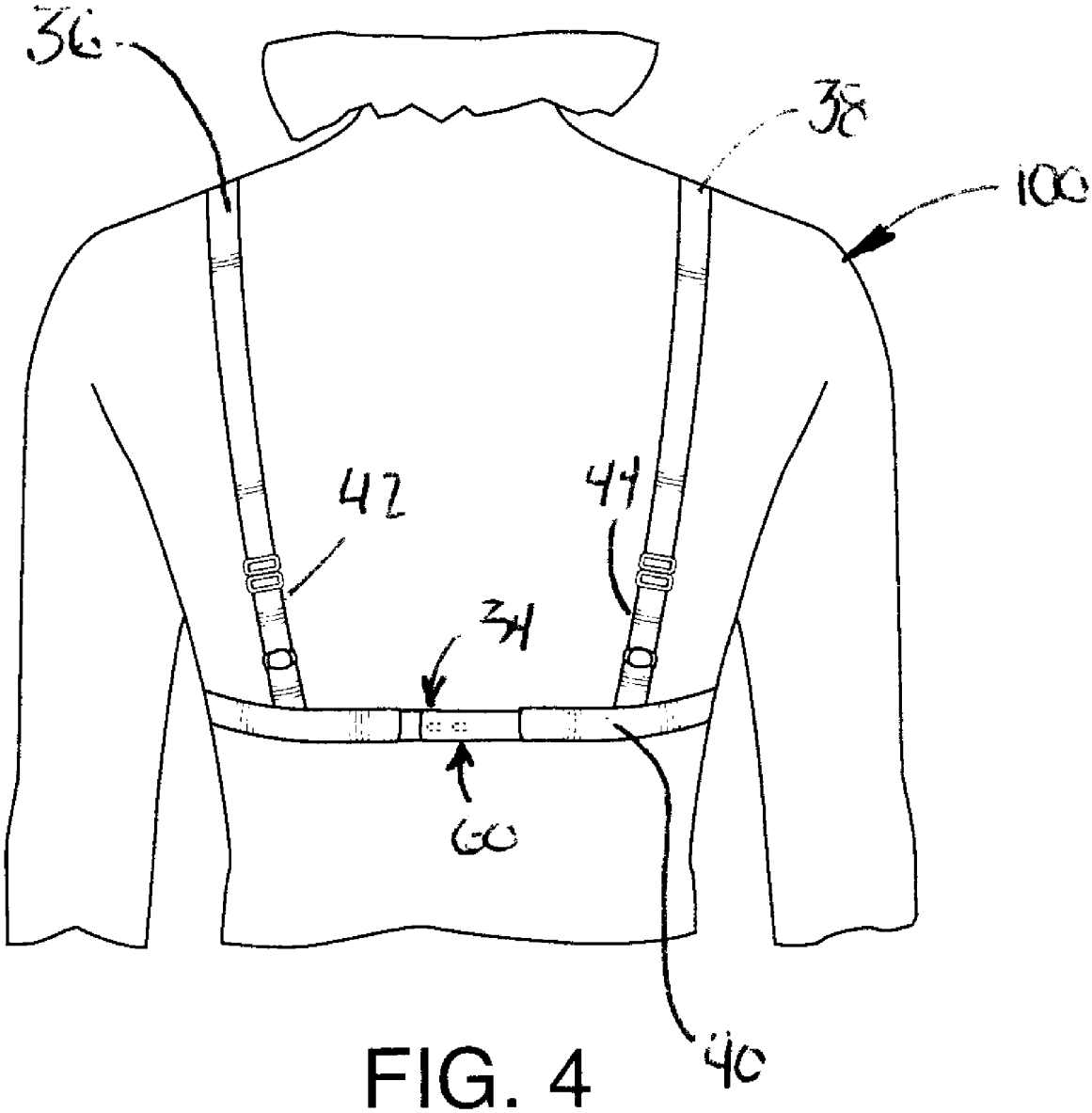
FIG. 4 is a rear perspective view of the nursing bra of FIG. 1 being worn by a user.

Two elongated shoulder straps, 36, 38, which may be elastic, upwardly extend respectively from the first and second breast cups 12, 14 for fastening around the user's shoulder and securing to a rear portion 40 of the elastic chest strap assembly 34 for fittingly retaining the breast cups 12, 14 in position to cover the user's breasts 110, as shown in FIG. 4. Each shoulder strap 36, 38 is preferably provided with a strap adjustment assembly 42, 44 for adjustably tightening each shoulder strap 36, 38, and hence connected breast cup 12, 14, to a user's upper torso portion.

With reference to FIG. 1, the chest strap assembly 34 includes first and second cup supporting straps 50, 52 and first and second chest straps 54, 56, each preferably formed of an elastic material. Each aforesaid strap 50-56 includes a first end all connected to one another at connection point 58, while the second ends of straps 50 and 54 are connected to a first end 59 of back torso strap 40 and the second ends of straps 52 and 56 are connected to a second end 61 of back torso strap 40.

As mentioned above, first cup supporting strap 50 is slidably received in the inner channel 30 portion of the bottom edge 26 of the first breast cup 12 while similarly the second cup supporting strap 52 is slidably received in the inner channel 32 portion of the bottom edge 28 of the second breast cup 14. As will be further discussed below regarding usage of nursing bra 10, the first and second supporting cup straps 50 and 52 are configured to permit each respective breast cup 12, 14 to slide along a respective strap member 50, 52 so as to expose a desired breast 110 for nursing applications.

It is to be appreciated that each first and second chest strap 54, 56 is functional to closely conform the breast strap assembly 34 to a user's chest to aid in the anchoring of the nursing bra 10 to a user's upper torso portion. Thus, while a user manipulates one or both the breast cups 12, 14 on its respective cup supporting strap 50, 52, each first and second chest supporting strap 54, 56 stays in conformity with a user chest. For instance, while a user manipulates a first breast cup 12, the second breast cup 14 stays anchored in place on the user's breast 110 unaffected by manipulation of the first breast cup 12, and vice versa.

With reference now to FIG. 4, the back torso strap 40 of strap assembly 34 extends around the user's back torso portion. Preferably the back torso strap 40 is provided with opposing ends connected to one another by a conventional clasping assembly 60, such as S-hooks and the like.

With the structure of an illustrated embodiment of the nursing bra 10 described above, discussion will now be provided regarding the use of nursing bra 10 during nursing applications.

Figure 3:
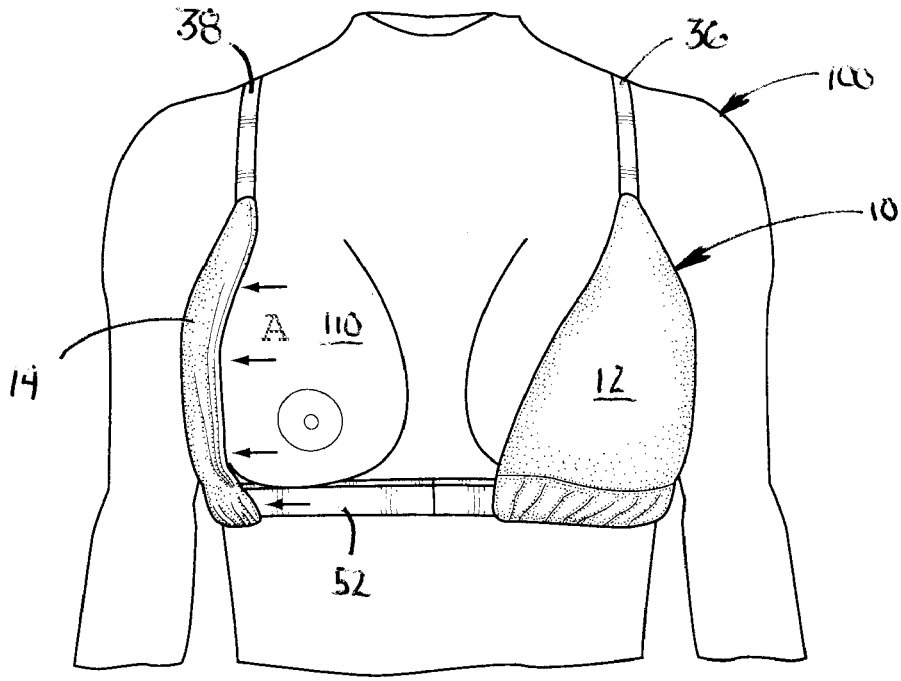
FIG. 3 is a front perspective view of the nursing bra of FIG. 1 being worn by a user wherein one of the breast cups is positioned to provide nursing access to a user's breast.

With reference now to FIGS. 2 and 3, the nursing bra 10 is supported on a user 100 such that the shoulder straps 36, 38 extend over the user's shoulders to the back torso strap 40, which is secured to a user via the clasping assembly 60 (FIG. 4). Each shoulder strap 36, 38 is adjusted on the user, via strap adjustment assemblies 42 and 44, such that each respective breast cup 12, 14 covers a desired portion of each respective breast 110.

When a user 100 desires to expose one of their breasts 110 for a nursing application, the user simply slides the breast cup 12, 14 covering that selected breast 110 along the associated cup supporting strap 50, 52 so as to expose the selected breast 110 to enable a nursing application. For instance, and with reference to FIG. 3, when a user 100 desires to expose a right-side breast 110, the user slides in the direction of arrows "A" the associated covering breast cup 14 along the associated supporting strap 52 so as to effectively expose the right-side breast 110 for a nursing application. And when the nursing application is complete, the user slides the aforesaid breast cup 14 in a direction substantially opposite of that of the direction of arrows "A" along the associated supporting strap 52 so as to once again cover the right-side breast 110 with the breast cup 14. It is again noted, that while the user 110 manipulates either breast cup 12, 14 to both expose and cover the associated breast 110, each first and second chest supporting strap 54, 56 of the strap assembly 34 stays in conformity with a user's chest effectively anchoring the nursing bra 10 to the user 100.

Although illustrated embodiments of the present invention have been described, it should be understood that various changes, substitutions, and alterations can be made by one of ordinary skill in the art without departing from the scope of the present invention.

What is claimed is:

1. A garment comprising:

first and second breast cups configured to a cover at least a portion of a user's breast, each first and second breast cup having a top edge and a bottom edge, wherein each bottom edge is formed with an inner channel portion;

first and second elongate shoulder straps each having a first end and a second opposing end, wherein said first end of said first elongate shoulder strap is coupled to said top edge of said first breast cup and said first end of said second elongate shoulder strap is coupled to said top edge of said second breast cup; and a chest strap assembly including:

a primary chest strap configured to conform against a front chest portion of said user so as to support said garment against said front chest portion of said user;

a rear strap configured to conform against a back torso portion of said user so as to support said garment against said back torso portion of said user; and a secondary chest strap configured to be slidably received in said inner channel portion of said first and second breast cup such that each said first and second breast cup is slidably adjustable on said secondary strap.

2. A garment as recited in claim 1 wherein said second ends of said first and second shoulder straps are coupled to said rear strap.

3. A garment as recited in claim 1 wherein each said first and second elongate shoulder strap is provided with an adjustment assembly.

4. A garment as recited in claim 1 wherein said rear strap is provided with a closure assembly.

5. A garment as recited in claim 1 wherein each said first and second breast cup is formed with elastic material.

6. A garment as recited in claim 1 wherein said primary chest strap and said secondary chest strap are positioned on said chest strap assembly in juxtaposed relationship to one another.

7. A garment as recited in claim 1 wherein said primary chest strap includes first and second primary chest strap members each having a first and second end wherein the first end of each first and second primary chest strap member is coupled to one another.

8. A garment as recited in claim 7 wherein said secondary chest strap includes first and second secondary strap members each having a first and second end wherein said first secondary chest strap member is slidably received in said inner channel of said first breast cup and said second secondary chest strap member is slidably received in said inner channel of the said second breast cup.

9. A garment as recited in claim 8 wherein said first end of each first and second secondary chest strap member is coupled to one another.

10. A garment as recited in claim 9 wherein said first end of each first and second primary chest strap member and said secondary strap member are coupled to one another.

11. A garment as recited in claim 10 wherein said second ends of each first primary and secondary chest strap members are coupled to a first end of said rear strap and said second ends of each second primary and secondary chest strap members are coupled to a second end of said rear strap.

12. A nursing bra assembly comprising:

first and second nursing breast cups configured to a cover at least a portion of a user's breast, each first and second breast cup having a top edge and a bottom edge, wherein each bottom edge is formed with an inner channel portion; and a chest strap assembly configured to secure said first and second nursing breast cups to said user, said chest strap assembly including:

a primary chest strap configured to conform against a front chest portion of said user so as to support said garment against said front chest portion of said user; and a secondary chest strap disposed in juxtaposed relationship to said primary chest strap configured to be slidably received in said inner channel portion of each said first and second breast cup such that said first and second breast cup is slidably adjustable on said secondary chest strap.

13. A nursing bra assembly as recited in claim 1 further including first and second elongate shoulder straps each having a first end and a second opposing end, wherein said first end of said first elongate shoulder strap is coupled to said top edge of said first breast cup and said first end of said second elongate shoulder strap is coupled to said top edge of said second breast cup.

14. A nursing bra assembly as recited in claim 13 further including a rear strap configured to conform against a back torso portion of said user so as to support said garment against said back torso portion of said user.

15. A nursing bra assembly as recited in claim 14 wherein said primary chest strap includes first and second primary chest strap members each having a first and second end wherein the first end of each first and second primary chest strap member is coupled to one another.

16. A nursing bra assembly as recited in claim 12 wherein said secondary chest strap includes first and second secondary chest strap members each having a first and second end wherein said first secondary chest strap member is slidably received in said inner channel of said first breast cup and said second secondary chest strap member is slidably received in said inner channel of the said breast cup.

17. A nursing bra assembly as recited in claim 16 wherein said first end of each first and second secondary chest strap member is coupled to one another.

18. A nursing bra assembly as recited in claim 17 wherein said first end of each first and second primary chest strap member and said secondary chest strap member are coupled to one another.

19. A nursing bra assembly as recited in claim 18 wherein said second ends of each first primary and secondary chest strap members are coupled to a first end of said rear strap and said second ends of each second primary and secondary chest strap members are coupled to a second end of said rear strap.

* * * * *